US005797512A

United States Patent [19]

Boland

[11] Patent Number: 5,797,512

[45] Date of Patent: Aug. 25, 1998

[54] DEVICE FOR COLLECTING DEBRIS ENTERING INTO A DUCT

[76] Inventor: Michael P. Boland, 9812 S. Ridgeway Ave., Evergreen Park, Ill. 60805

[21] Appl. No.: 797,410

[22] Filed: Feb. 10, 1997

[51] Int. Cl.[6] ..... B65D 33/00

[52] U.S. Cl. ..... 220/404; 220/403

[58] Field of Search ..... 220/401, 403, 220/404, 409, 410, 477, 480, 9.1

[56] References Cited

U.S. PATENT DOCUMENTS

| | | | |
|---|---|---|---|
| 2,610,757 | 9/1952 | Irvine | 220/403 |
| 2,821,262 | 1/1958 | Godwin | 183/52 |
| 3,422,985 | 1/1969 | Rinehart | 220/404 X |
| 3,487,989 | 1/1970 | Rausing et al. | 220/404 X |
| 3,596,441 | 8/1971 | Lundahl | 55/376 |
| 3,606,740 | 9/1971 | Ballennie | 55/500 |
| 3,966,434 | 6/1976 | Frazier | 55/96 |
| 3,977,450 | 8/1976 | Schampier | 220/404 X |
| 4,919,546 | 4/1990 | Imazeki et al. | 220/403 X |
| 4,948,266 | 8/1990 | Bencic | 220/404 X |
| 5,636,871 | 6/1997 | Field | 220/404 X |

*Primary Examiner*—Steven M. Pollard

*Attorney, Agent, or Firm*—Trexler, Bushnell, Giangiorgi & Blackstone, Ltd.

[57] ABSTRACT

A collection device and method for collecting debris entering into an opening of a duct associated with a ventilation system of a house or other building. The device including a basket having a fastening portion and a collecting portion detachably secured to the fastening portion. The fastening portion is adapted to be secured to a duct or to a sub-flooring adjacent the opening, and the collecting portion is adapted to extend into the duct and receive the debris. A strap in the form of a drawstring may be included for detaching the collecting portion from the fastening portion and removing the collecting portion from the sub-flooring. The collection device may include a weight for maintaining the basket within the duct.

23 Claims, 2 Drawing Sheets

DEVICE FOR COLLECTING DEBRIS ENTERING INTO A DUCT

The present invention relates to a device and method for collecting debris entering into a duct of a ventilation system of a house or other building during construction of the building.

BACKGROUND

The construction of a house involves several stages. One of the preliminary stages of construction is the "rough stage", during which rough carpentry occurs and the frame of the house is constructed and the duct work for the forced air system or other ventilation system is laid.

Typically, once the rough stage is completed, the "prep stage" occurs, during which the various trades, such as plumbers, heating contractors and electricians, conduct their initial preparation work. As each of the various trades works during the prep stage, debris, such as, for example, wood particles, metal particles, wiring and conduit particles, dust, etc., tends to build up inside the house. The debris tends to settle on the sub-flooring but also tends to fall into the duct openings associated with the sub-flooring. While the debris that settles on the sub-flooring can be cleaned relatively easily, the debris that falls into such floor duct openings can not be readily removed. Such debris and other matter can also have significant detrimental effects on the ventilation system and result in a poor breathing environment for the occupants. It also is not uncommon for animals such as cats, rodents or skunks to enter into the floor duct openings during the construction of a house.

Accordingly, it is an object of the present invention to provide a device and method for preventing the build up of debris or other matter within a duct during the construction of a house or other building.

It is a further object of the present invention to provide such a device and method wherein at least a portion of the device can be quickly and easily removed from the duct and discarded once a predetermined amount of the debris is collected within that portion.

It is still a further object of the present invention to provide such a device that is able to remain substantially within the duct even when air is being passed through the duct by the ventilation system.

SUMMARY

In accordance with these and other objects, a collection device is provided for collecting debris entering into a duct associated with a ventilation system, such as a forced air system or the like, of a house or other building during the construction of the building. The collection device includes a disposable basket having open and closed ends and outer and inner surfaces that preferably extend from the open end substantially to the closed end. The basket defines a chamber that desirably extends from the open end substantially to the closed end. In accordance with a preferred embodiment, the basket is adapted to extend into a hole that is defined by the sub-flooring or other floor structure and is associated with an opening of the duct.

The basket desirably includes a fastening portion and a collecting portion. The fastening portion is adapted to be engaged with the duct by securing it to the duct or to the sub-flooring or other floor structure adjacent or about the hole in any suitable manner, such that the collecting portion extends substantially into the duct opening and the closed end of the basket is received by the duct. The collecting portion desirably is detachably secured to the fastening portion in any suitable manner so that the collecting portion and the debris collected therein can be quickly and easily removed from the duct and discarded. In a preferred embodiment, for example, the collecting portion is detachably secured to the fastening portion by perforations or the like that extend around the basket and are spaced from the open end of the basket.

Preferably, the collecting portion is constructed of a material that is sufficiently porous such that air passing through the duct can also pass through the collecting portion. If desired, the collecting portion may include near its upper end an annular band or the like constructed of high porous material, such as, for example, a synthetic nylon or the like, that further facilitates air flow through the collecting portion.

The collection device preferably includes a strap of any suitable configuration to facilitate quick and easy detachment of the collecting portion from the fastening portion and removal of the collecting portion from the duct by manually pulling the strap. The strap preferably is in the form of a drawstring associated with the collecting portion so that the collecting portion also encloses as the drawstring is pulled and as the collecting portion is being detached from the fastening portion. The drawstring desirably includes a pair of loops, which can be pulled separately or together to facilitate detachment and removal of the collecting portion. Preferably, the loops extend into the chamber from the inside surface of the collecting portion of the basket.

If desired, the collection device may include a colored marking or the like on the basket to facilitate quick and easy positioning of the basket relative to the duct. The marking desirably is in the form of an annular ring on the fastening portion that extends around the chamber and is visible on the outer and inner surfaces of the basket. The top of the ring preferably is adapted to be aligned with the end of the duct so that the ring extends substantially within the duct when the fastening portion of the basket is secured to the duct or sub-flooring.

In accordance with a preferred embodiment, the device also includes a weight for maintaining the basket substantially within the duct when air is flowing through the duct toward the duct opening. The weight is secured to or otherwise associated with the basket, and may comprise metal or any other suitable material.

The present invention also includes a method for collecting and removing debris that enters into the opening of the duct including the steps of engaging the fastening portion of the basket with the duct by securing the fastening portion to the duct or to the sub-flooring or other floor structure adjacent the duct opening, detaching the collecting portion from the fastening portion basket after a predetermined amount of debris has been collected within the collecting portion, and removing the collecting portion from the duct. The detaching and removing steps desirably are performed substantially concurrently by manually pulling the strap away from the duct. Preferably, the collecting portion also encloses as the strap is pulled.

Accordingly, the present invention provides a collection device and method for collecting and removing debris entering into the duct to prevent the build-up of the debris within the duct. The present invention prevents the debris from entering into the ventilation system during construction of the house or building, and, thus, will provide a better breathing environment for the occupants of the house or building. The collection device is also adapted to prevent animals from entering the duct.

The invention can be used with any existing duct even if the ventilation system has not yet been completed or is not yet operable. The collection device can be quickly and easily secured to the duct or the sub-flooring or other floor structure and the debris collected by the device can be quickly and easily removed. The device also is inexpensive and relatively easy to manufacture.

BRIEF DESCRIPTION OF DRAWINGS

The present invention and the advantages thereof will become more apparent upon consideration of the following detailed description when taken in conjunction with the accompanying drawings.

DETAILED DESCRIPTION OF PREFERRED EMBODIMENTS

Figure 1:
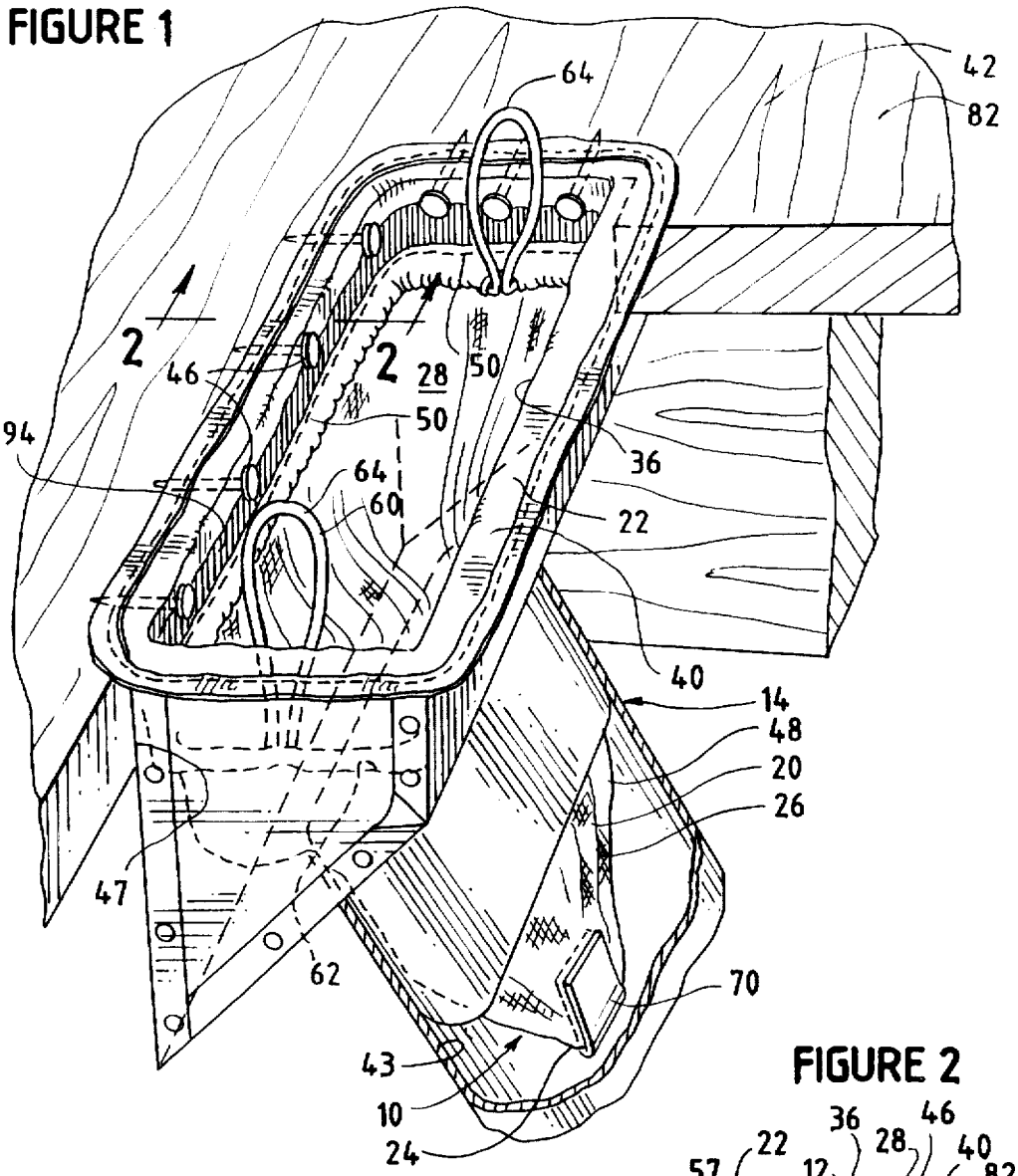
FIG. 1 is a perspective view of a collection device in accordance with a preferred embodiment of the invention and a fragmentary view of a duct and a sub-flooring defining a hole associated with an opening of the duct, illustrating the collection device received within the opening and secured to the duct by a plurality of nails that also secure the duct to the sides of the sub-flooring.

FIGS. 1–4 illustrate a collection device 10 in accordance with preferred embodiments of the invention for collecting debris entering into an opening 12 of a duct 14. The device 10 includes a basket 20 or the like having an open end 22, a closed end 24, and outer and inner surfaces 26 and 28 extending from the open end substantially to the closed end. The basket 20 defines a chamber 36 that also extends from the open end 22 substantially to the closed end 24.

Figure 2:
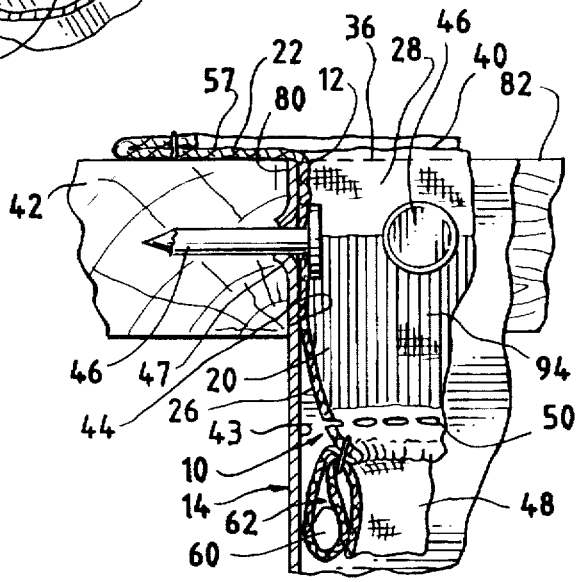
FIG. 2 is a cross section taken along the lines 2—2 of FIG. 1.

The basket 20 includes fastening portion 40 that may be secured to the duct 14 or to a sub-flooring 42 or other floor structure that preferably defines a hole 44 adjacent or otherwise associated with the duct opening 12. In the embodiment of FIGS. 1 and 2, for example, the fastening portion 40 is secured to the inside of the wall 43 of the duct 14 by a plurality of nails 46 that also extend through the duct and into the sides 47 of the sub-flooring 42 that define the hole 44. The basket 20 also includes a collecting portion 48 received within the duct 14 for receiving and collecting the debris. Desirably, the collecting portion 48 is detachably secured to the fastening portion 40 in any suitable manner such as, for example, by perforations 50 or the like. If desired, a portion 52 of the collecting portion 48 may be arcuate to complement a bend or turn 56 often existing in ductwork extending below sub-flooring (see, e.g., FIG. 4). In the illustrated embodiment a leading edge 57 of the fastening portion is folded over and stitched.

The collection device 10 further includes a strap 60 to facilitate quick and easy detachment of the collecting portion 48 from the fastening portion 40 and removal of the collecting portion from the duct 14 after a predetermined amount of the debris has accumulated in the collecting portion. The strap 60 may be in any form suitable to facilitate detachment and desirably removal of the collecting portion 48. In accordance with a preferred embodiment, the strap 60 is engaged with the collecting portion 48 of the basket 20 so that the collecting portion can be detached and removed from the duct 14 by simply pulling the strap. In the illustrated embodiment, the strap 60 is received within an annular passage 62 defined by the collecting portion 48. In the illustrated embodiment, the passage 62 is defined by stitching. The strap may include two loops 64 extending from the passage 62 into the chamber 36. Desirably, the strap 60 is in the form of a drawstring so that the collecting portion 48 also encloses as the drawstring is pulled.

The basket 20 preferably is constructed of a material or a combination of different materials suitable to allow air to pass through the collecting portion 48. The basket 20 may, for example, be constructed of polyolefin or a similar material. Additionally, or alternatively, the collecting portion 48 may include an air flow portion 58 constructed of a high porous material, such as, for example, a synthetic nylon, a nylon, or any other suitable material, to further facilitate air flow through the collecting portion (see FIG. 4). The air flow portion 58 desirably extends annularly, and is near the upper end of the collecting portion 48 so that collected debris does not significantly interfere with the passage of air through the air flow portion.

In accordance with a preferred embodiment of the invention, the collection device 10 also includes a weight 70 associated with the basket 20 for maintaining the closed end 24 of the basket within the duct 14. The weight 70 desirably is secured adjacent the closed end 24 of the basket 20 in any suitable manner. In the illustrated embodiment, for example, the weight 70 is generally rectangular and is clamped to the outer surface 26 of the basket 20 at the closed end 24. Alternatively, the basket 20 may include a pocket or the like which houses the weight 70.

The weight 70 may comprise sheet metal or any other suitable material that desirably is sufficiently heavy to maintain the closed end 24 of the basket 20, and preferably substantially the entire length of the collecting portion 48, within the duct 14 when air is being passed through the duct to the opening 12 by the ventilation system. On the other hand, the weight 70 desirably is sufficiently light such that the collecting portion 48 can be detached from the fastening portion 40 and manually removed from the duct 14 after the predetermined amount of the debris has been received by the collecting portion.

In accordance with a preferred embodiment of the invention, the basket 20 is readily secured to the duct 14 or sub-flooring 42 in any suitable manner, such that the closed end 24 of the basket and most of the length of the basket extends into the duct 14. The manner of securing the basket 20 to the duct 14 or sub-flooring 42 may depend upon the stage of construction of the ductwork and the location and design of the duct 14.

In FIGS. 1 and 2, for example, the fastening portion 40 is secured to the inside of the wall 43 of the duct 14 by the nails 46. If the duct 14 has not yet been installed, the basket 20 may be positioned within the duct as the duct is being installed, in which case the nails 46 may then be driven through the fastening portion 40 and into the sides 47 of the sub-flooring 42 to also secure the duct to the sub-flooring. The fastening portion 40 may be extended beyond the end 80 of the duct 14 and, if desired, folded onto the top surface 82 of the sub-flooring 42 surrounding the hole 44 so that debris does not fall around the outside of the end 80 of the duct 14 (see, e.g., FIGS. 1 and 2).

Figure 3:
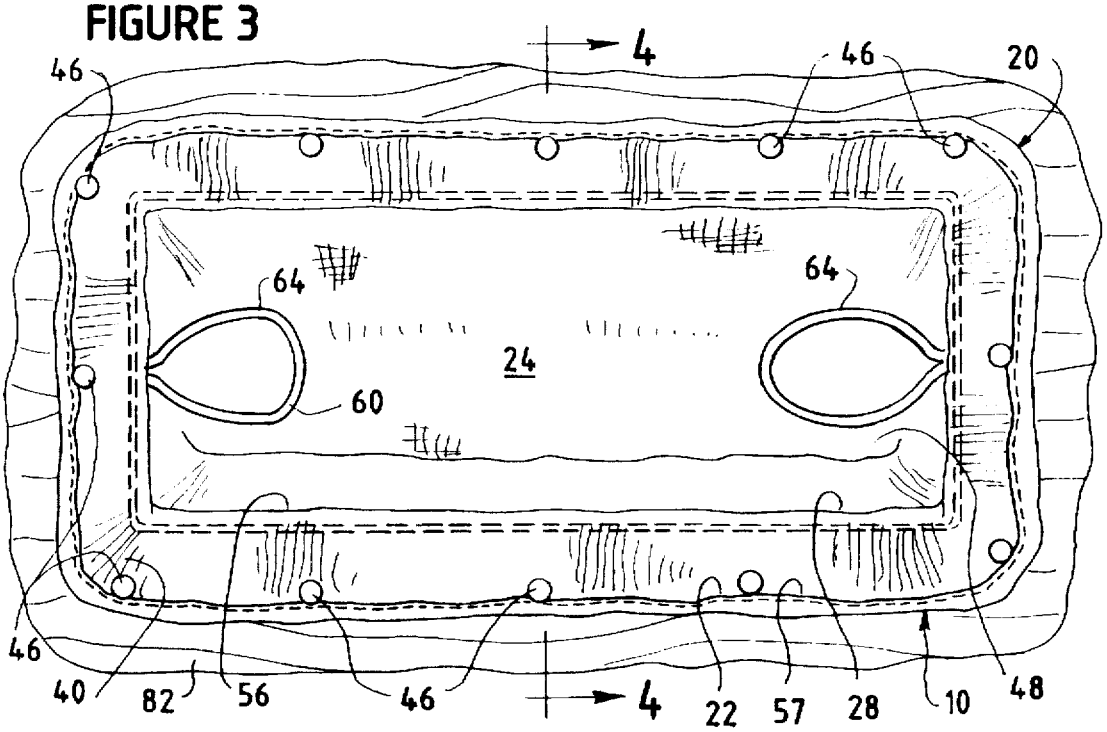
FIG. 3. is a top plan view of the collection device of FIG. 1 secured to a top surface of the sub-flooring.
Figure 4:
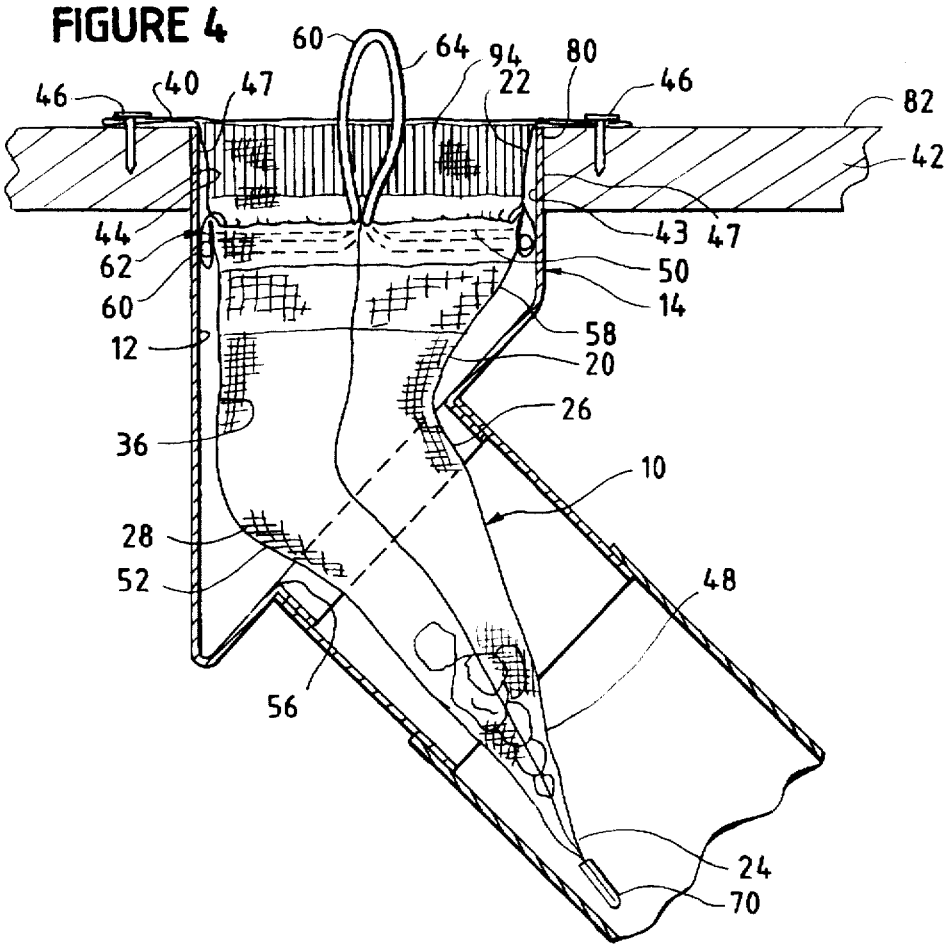
FIG. 4. is a cross section taken along the lines 4—4 of FIG. 3, also illustrating a band of material of high porosity included on the basket to facilitate air flow through the basket.

Alternatively, the fastening portion 40 may be nailed or otherwise fastened to the top surface 82 of the sub-flooring 42 that surrounds the hole 44 (see, e.g., FIGS. 3 and 4). This method of fastening may be preferable if the duct 14 is already installed.

The collection device 10 desirably further includes a visual marking on the basket 20 to facilitate quick and easy positioning of the basket relative to the duct 14 for securing to the sub-flooring 42. In the illustrated embodiment, the marking is in the form of an annular ring 94 visible on the outer and inner surfaces 26 and 28 of the basket 20 that extends around the fastening portion 40. With this embodiment, the top of the ring 94 may be aligned with the top surface 82 of the sub-flooring 42 or the end 80 of the duct 14, so that a portion of the fastening portion 40 extending above the ring 94 may extend outside of the duct 14. Alternatively, any other suitable marking may be used to facilitate positioning of the basket 20 relative to the duct 14.

The present invention also includes a method for collecting and removing debris that enters into the duct opening 12 including the steps of (a) engaging the fastening portion 40 of the basket 20 with the end 80 of the duct such that the collecting portion 48 extends into the duct 14 and the closed end 24 of the basket 20 is received by the duct, (b) detaching the collecting portion 48 from the fastening portion after a predetermined amount of debris has been collected within the collecting portion, and (c) removing the collecting portion from the duct 14. Step (a) may include rigidly securing the fastening portion 40 to the duct 14 or to the sub-flooring 42 or other floor structure by the nails 46, tacks or any other fasteners or suitable securing means. Steps (b) and (c) may be performed substantially concurrently by pulling one or both of the loops 64 of the strap 60 away from the duct 14. Desirably, the collecting portion 48 substantially encloses as the loop 64 is pulled. The collecting portion 48 and the debris contained therein may then be discarded. The collection device 10 is also adapted to prevent animals from entering the duct 14.

The present invention provides several benefits. For example, it prevents the build-up of debris within the duct and from entering into the ventilation system during construction of a house or other building. The device is easy to use since it can be quickly and easily secured to the duct or sub-flooring or other floor structure, and the collecting portion of the basket and the debris can be quickly and easily removed and discarded. The present invention will provide a better breathing for the occupants of the house or other building by controlling the debris which can enter the ventilation system. The device in accordance with preferred embodiments is also inexpensive and relatively easy to manufacture.

The foregoing description is for purposes of illustration only and is not intended to limit the scope of protection accorded this invention. The scope of protection is to be measured by the following claims, which should be interpreted as broadly as the inventive contribution permits.

The claimed invention is:

1. A collection device for collecting debris entering into an opening of a duct in a building the collection device comprising:

(a) a basket including an open end, a closed end, an outer surface extending from the open end toward the closed end, and an inner surface extending from the open end toward the closed end and defining a chamber extending from the open end toward the closed end, the basket further including a collecting portion for receiving the debris and a fastening portion, unitary with said collecting portion adapted to be engaged with the duct such that the collecting portion extends into the duct opening and the closed end is within the duct, the collecting portion being detachably secured to the fastening portion by perforations for detaching and removing the collecting portion from the fastening portion; and (b) a strap associated with the basket for removing the collecting portion from the duct after a predetermined amount of the debris has been received by the collecting portion.

2. The collection device of claim 1 wherein the strap is engaged with the collecting portion.

3. The collection device of claim 2 wherein the strap is a drawstring adapted to substantially enclose the collecting portion of the basket as the drawstring is pulled.

4. The collection device of claim 1 wherein the strap includes at least one loop extending into the chamber.

5. The collection device of claim 1 wherein the collecting portion of the basket defines an annular passage receiving the strap.

6. The collection device of claim 1 wherein the strap is a drawstring engaged with the collecting portion adapted to substantially enclose the collecting portion of the basket as the drawstring is pulled.

7. The collection device of claim 1 wherein the fastening portion is adapted to be secured to a sub-flooring that extends around a hole defined by the sub-flooring and associated with the duct opening.

8. The collection device of claim 1 wherein the fastening portion is adapted to be secured to the duct.

9. The collection device of claim 1 wherein at least a portion of the collecting portion is comprised of polyolefin.

10. The collection device of claim 1 wherein the collecting portion includes an air flow portion comprised of a material having a porosity higher than another portion of the collecting portion.

11. The collection device of claim 10 wherein said air flow portion extends annularly.

12. The collection device of claim 10 wherein said material of higher porosity is a synthetic nylon.

13. The collection device of claim 1 further including a marking on the basket for positioning the basket relative to the duct.

14. The collection device of claim 13 wherein the marking is on the fastening portion of the basket.

15. The collection device of claim 13 wherein the marking extends annularly around the basket.

16. The collection device of claim 1 further including a weight associated with the basket.

17. The collection device of claim 16 wherein the weight is at the closed end of the basket.

18. A collection device for collecting debris entering into an opening of a duct in a building, the collection device comprising:

(a) a basket including an open end, a closed end, an outer surface extending from the open end toward the closed end, and an inner surface extending from the open end toward the closed end and defining a chamber extending from the open end toward the closed end, the basket further including a collecting portion for receiving the debris and a fastening portion, unitary with said collecting portion adapted to be engaged with the duct such that the collecting portion extends into the duct opening and the closed end is within the duct, the collecting portion including an air flow portion near an upper end of the collecting portion, the air flow portion comprising a material of higher porosity than an other portion of the collecting portion, the collecting portion being detachably secured to the fastening portion by perforations for detaching and removing the collecting portion from the fastening portion; and (b) a strap associated with the basket for removing the collecting portion from the duct after a predetermined amount of the debris has been received by the collecting portion.

19. The collection device of claim 18 wherein the air flow portion extends annularly.

20. The collection device of claim 18 wherein the material of higher porosity is a synthetic nylon.

21. The collection device of claim 18 wherein the strap is engaged with the collecting portion, and the strap is a drawstring adapted to substantially enclose the collecting portion of the basket as the drawstring is pulled.

22. The collection device of claim 18 further including a marking on the basket for positioning the basket relative to the duct.

23. The collection device of claim 18 further including a weight associated with the closed end of the basket.

* * * * *